United States Patent [19]

Cliburn

[11] Patent Number: 4,838,237

[45] Date of Patent: Jun. 13, 1989

[54] ARROW REST FOR ARCHERY BOWS

[76] Inventor: Samuel D. Cliburn, 7320 Hwy. 50 West, Jefferson City, Mo. 65109

[21] Appl. No.: 202,585

[22] Filed: Jun. 6, 1988

[51] Int. Cl.[4] ..... F41B 5/00

[52] U.S. Cl. ..... 124/41 A; 124/24 R

[58] Field of Search ..... 124/24 R, 24 A, 41 A, 124/88

[56] References Cited

U.S. PATENT DOCUMENTS

| | | | |
|---|---|---|---|
| 3,406,676 | 10/1968 | Dye | 124/24 R |
| 3,919,997 | 11/1975 | Day | 124/24 R |
| 3,935,854 | 2/1976 | Troncosco, Jr. | 124/24 R |
| 4,236,497 | 12/1980 | Troncoso, Jr. | 124/24 R |
| 4,318,390 | 3/1982 | Trotter | 124/41 A |
| 4,332,232 | 6/1982 | Troncoso, Jr. | 124/24 R |

*Primary Examiner*—Randolph A. Reese
*Assistant Examiner*—Anthony Knight
*Attorney, Agent, or Firm*—Kokjer, Kircher, Bradley, Wharton, Bowman & Johnson

[57] ABSTRACT

An arrow rest is attached to an archery bow by a rigid mounting bracket having a projecting pin on which the arrow rest is carried. The arrow rest includes a mounting base and two pivot blocks which pivot independently. Each pivot block has a separate spring which biases it in a direction to normally maintain the fingers in positions where an arrow can be held in a stable seat found between oppositely curved tips of the fingers. Each finger can deflect from its normal position independently of the other finger so that differential deflection of the fingers can take place when they are subjected to differential forces applied by the arrow.

11 Claims, 1 Drawing Sheet

ARROW REST FOR ARCHERY BOWS

BACKGROUND AND SUMMARY OF THE INVENTION

This invention relates in general to archery equipment and deals more particularly with an improved arrow rest for an archery bow.

In the past, archery bows have been equipped with various types of arrow rests which hold arrows positioned in the bow. Examples are the arrow rests disclosed in U.S. Pat. Nos. 3,935,854 and 4,332,232. In the known arrow rests that have been available commercially, a pair of fingers which support the arrow on their tips extend from a rotatable shaft. A spring urges the shaft to rotate in one direction to normally maintain the fingers in position to receive the arrow and yet permit the fingers to "give" when the arrow is shot and exerts a force on them sufficient to overcome the spring force.

These commercially available arrow rests are not entirely satisfactory in all respects. Because both fingers are mounted on the same shaft, both of the fingers must move together in the same direction at the same time. If the arrow is skewed somewhat in the bow to one side or the other, it exerts more force on one finger than the other. However, because the two fingers are mounted rigidly with one another, they must yield or give together even though one is subjected to more force than the other. Consequently, the arrow can bind in the arrow rest or can fall off of it more to one side than to the other side, and the arrow can travel off line as a result.

Existing arrow rests also have fingers which curve at their tips toward one another, and the arrow is thus held on the tips somewhat insecurely and can roll off of the fingers, especially if the bow is tilted. Because a single spring must hold both fingers in place, a rather stiff spring is required and the considerable force of the stiff spring must be overcome before the fingers can deflect. The spring force 15 also applied at a location offset from the fingers, and the spring can cause skewing or binding of the components of the arrow rest.

The present invention provides an improved arrow rest in which a pair of fingers that hold the arrow are able to deflect independently of one another. In accordance with the invention, a mounting bracket secured to the bow carries a pin on which a mounting base for the arrow rest is secured. A pair of blocks are pivotally mounted on opposite sides of the base for movement separately nd independently of one another about the pivot axis of the pin. A finger extends from each pivot block, and the fingers have tips which curve away from another to provide a stable seating area for receiving and holding the arrow.

Each finger has a separate spring, and the two springs act independently to urge the pivot blocks in a direction to normally maintain the fingers parallel to one another in a position to receive the arrow. Because each finger is independently mounted and has its own separate spring, the fingers can deflect separately and independently of one another. Thus, one finger can deflect more than the other finger when unequal forces are applied to the two fingers. As a result, the arrow rest is able to accommodate arrows that are placed in the bow at a skewed orientation without throwing the arrow off line. Likewise, the arrow does not bind in the arrow rest or inadvertently fall off of the fingers. In the latter respect, the outward curve of the fingertips is important in that is provides a stable seating area for the arrow and maintains the arrow securely in place in the arrow rest. Another benefit of providing each finger with its own spring is that relatively small springs can be used and each finger can deflect whenever a force is applied to it sufficient to overcome the spring force that opposes deflection.

DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENION

Figure 2:
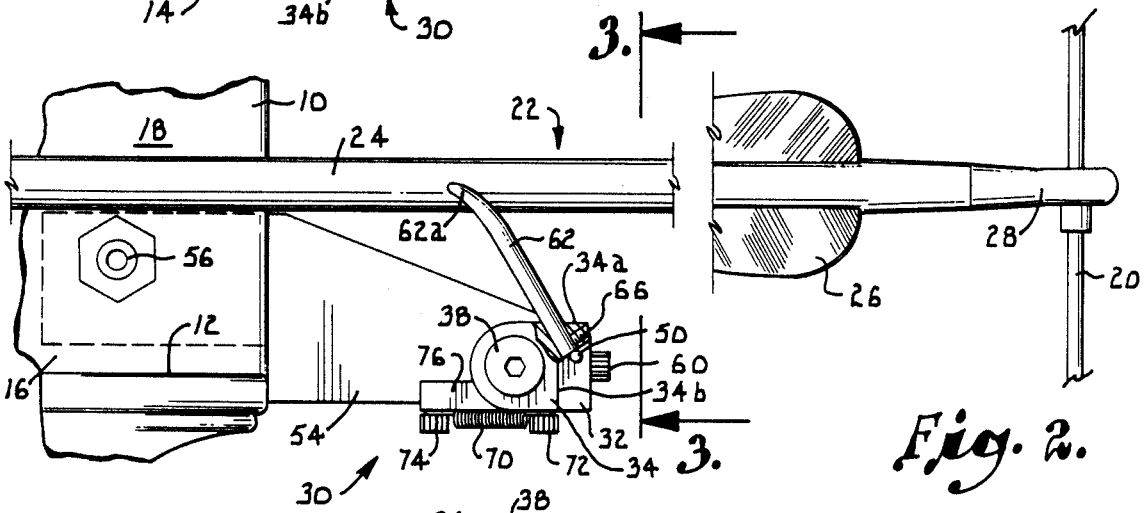
FIG. 2 is a fragmentary side elevational view showing the arrow rest applied to the bow and an arrow applied in the bow in a position for shooting, with a portion of one pivot block shown in section for illustrative purposes and the break lines indicating continuous length of the arrow.

Referring now to the drawing in more detail, numeral 10 designates a conventional archery bow of the type that may be equipped with the arrow rest of the present invention. The bow 10 includes near its center a horizontal shelf 12 located slightly above a hand grip 14 by which the bow is held during shooting of an arrow. A sidewall 16 intersects with the shelf 12 and cooperates with the shelf to define an arrow window 18 through which an arrow projects when it is placed in the bow in position to be shot. The bow 10 has the usual string 20 (see FIG. 2). A conventional arrow 22 having a shaft 24 and feathers 26 (FIG. 2) may be placed in the bow with its forked base end 28 applied to the string 20 and the shaft 24 of the arrow extending through the arrow window 18. The arrow may be shot in the usual manner by drawing the string 20 back and then releasing it to propel the arrow at the target.

Numeral 30 generally designates an arrow rest constructed in accordance with a preferred embodiment of the present invention. The arrow rest 30 includes a mounting base 32 and a pair of pivot blocks 34 and 36 which are pivoted to opposite sides of the mounting base 32. A shoulder bolt 38 extends through aligned apertures in the mounting base 32 and the two pivot blocks 34 and 36. The end of the pivot bolt 38 is threaded at 40 (see FIG. 3) into one end of a cylindrical pin 42. The mounting base 32 and pivot blocks 34 and 36 are held between the head of the shoulder bolt 38 on one side and a pair of nuts 44 which are threaded onto pin 42 on the opposite side.

Figure 4:
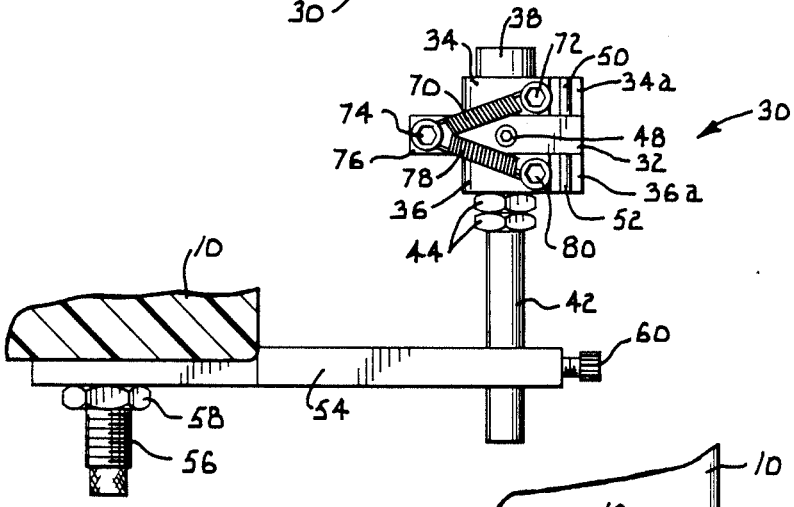
FIG. 4 is a fragmentary bottom plan view showing the arrow rest attached to the bow.

The mounting base 32 is fixed on the shoulder bolt 38 against rotation thereon by a set screw 48 (FIG. 4) which is threaded into the bottom of the base 32 and tightened against the shank of the shoulder bolt. Each pivot block 34 and 36 is supported to pivot about the axis of the shoulder bolt 38 and the pin 42 which is axially aligned with the shoulder bolt.

Figure 5:
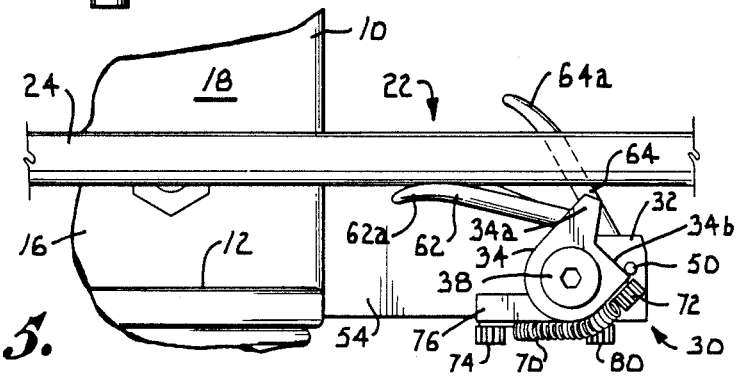
FIG. 5 is a fragmentary elevational view similar to FIG. 2, but showing one of the fingers of the arrow rest deflected fully away from its normal position due to a force applied by the arrow.

A pair of pins 50 and 52 project in opposite directions from the mounting base 32. The pins 50 and 52 serve as stops which limit the pivotal movement of the respective blocks 34 and 36. Block 34 has a rearwardly projecting lug 34*a* which engages the stop pin 30 to limit pivotal movement of block 34 in a clockwise direction as viewed in FIG. 2. Pivotal movement of block 34 in the opposite direction is limited by engagement of a flat surface 34*b* on the block with the stop pin 50, as best shown in FIG. 5. The other pivot block 36 similarly has a rearwardly projecting lug 36*a* and a flat surface 35*b* which engage pin 52 to limit the pivotal movement of block 36 in opposite directions.

The arrow rest 30 is mounted on the bow 10 by a rigid bracket 54. The bracket 54 has a base end which is secured to the side wall 16 of the bow by a bolt 56 and a nut 58 tightened onto the bolt and against the wall 16. The bracket 54 projects to the rear from the bow 10 and includes on the end opposite its base an aperture through which the pin 42 extends. A set screw 60 which is threaded into the end of the bracket 54 may be tightened against the pin 42 in order to rigidly secure the pin 42 and the arrow rest 30 on the bow.

It is noted that the pin 42 may be adjusted axially relative to bracket 54 when the set screw 60 is loosened. Consequently, the arrow rest 30 may be adjusted laterally of the bow. The pin 42 has a horizontal orientation when the bow is oriented vertically, and the mounting base 32 and the two pivot blocks 34 and 36 are located between the bow 10 and the string 20 and are generally aligned with the arrow shelf 12.

A finger 62 is secured to pivot block 34. The finger 62 extends into a passage formed through the lug 34*a*. A set screw 66 is threaded into the end of the lug 34*a* and may be tightened against finger 62 in order to secure it rigidly in place on the block 34. Another finger 64 is similarly secured to block 36. Finger 64 is extended through a passage in the lug 36*a* and is secured in place by a set screw 68 which is threaded into the end of lug 36*a* and may be tightened against the finger 64.

Figure 1:
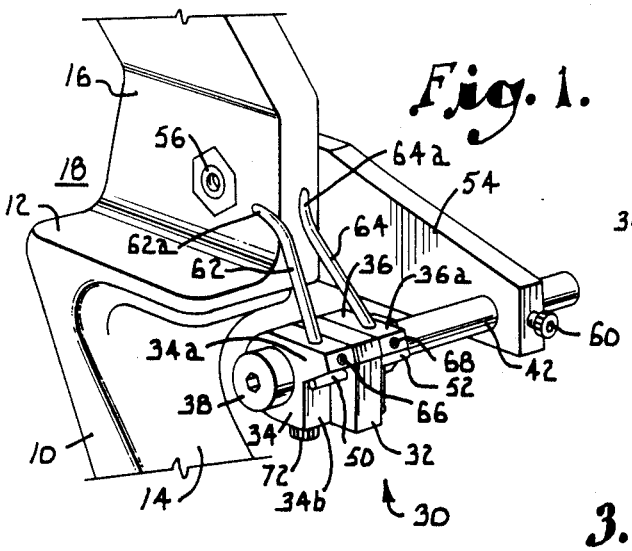
FIG. 1 is a fragmentary perspective view showing an archery bow equipped with an arrow rest constructed according to a preferred embodiment of the present invention.
Figure 3:
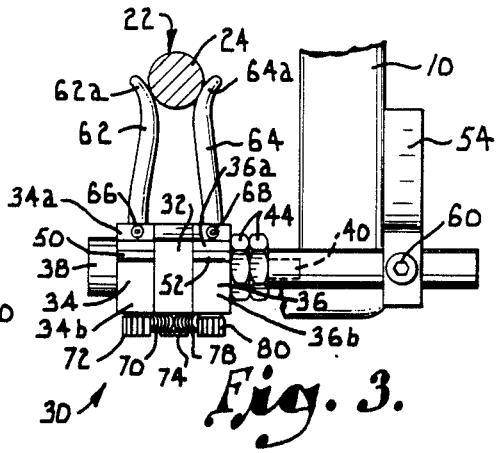
FIG. 3 is a fragmentary sectional view taken generally along line 3—3 of FIG. 2 in the direction of the arrows.

The fingers 62 and 64 can be adjusted axially when the set screws 66 and 68 are loosened. Finger 62 terminates in a curved tip portion 62*a* on its free end, and the other finger 64 has a similarly curved tip portion 64*b*. As best shown in FIG. 3, the tip portions 62*a* and 64*b* curve outwardly or away from one another in order to provide a stable and secure seating area for the arrow 22.

Pivot block 34 is continuously biased toward a normal position in which the lug 64*a* engages pin 50. A small tension spring 70 is hooked at one end to a screw 72 threaded into the underside of block 34. The opposite end of spring 70 is hooked to another screw 74 which is threaded into a forwardly projecting lug 76 which forms part of the mounting base 32. The spring 70 thus acts on pivot block 34 in a manner to urge the pivot block 34 in a clockwise direction as viewed in FIGS. 2 and 5. When block 34 is deflected from its normal position, the spring 70 is placed under tension, and the tension of the spring thus opposes the deflection of the block and urges it to return to the normal position.

The other pivot block 36 is provided with its own spring 78 which acts similarly to but independently of spring 70. Spring 78 is hooked at one end to a screw 80 threaded into the bottom of block 36. The opposite end of spring 78 is hooked to the screw 74. Spring 78 thus acts on block 36 to normally maintain it with the lug 36*a* in contact with the stop pin 52. Block 36 can be deflected away from its normal position against the force of spring 78 which continuously urges the block to return to its normal position.

It is important to recognize that the two pivot blocks 34 and 36 are mounted to pivot independently of one another. Similarly, the two springs 70 and 78 act independently of one another so that the two blocks 34 and 36 can pivot independently of one another. In the normal position of the arrow rest, the fingers 62 and 64 are united somewhat toward one another and incline forwardly from bottom to top. The fingers are spaced apart far enough that the shaft 24 of arrow 22 can be received and supported on the seating area that is provided between the two curved tips 62*a* and 64*a*. The tips 62*a* and 64*a* are located well above the shelf 12 and are spaced behind the bow and between the bow and the string 20. It should be noted that the height of the tips 62*a* and 64*a* can be adjusted by adjusting the fingers 62 and 64 axially.

In use, the arrow 22 is placed in the bow in position for shooting, with the forked base 28 applied to the string 20 and the shaft 24 applied to the seating area defined on the curved tips 64*a* and 64*b* of the fingers of the arrow rest. The arrow then extends through the arrow window 18 at a location somewhat above the shelf 12.

When the string 20 is drawn back and released to shoot the arrow, the arrow shaft applies a force to the fingers 62 and 64. The force may be applied unequally to the two fingers, and it is an important feature of the invention that the two fingers can deflect independently of one another to different degrees. For example, if the arrow applies a significant force to the left finger 62 and no significant force to the right finger 64, the right finger 64 does not deflect whereas the left finger 62 can deflect fully as shown in FIG. 5. Consequently, the arrow does not bind in the arrow rest or become thrown off line, since only the finger 62 which should deflect is deflected and the other finger 64 remains in its normal position to guide the arrow in a straight line path toward the target. As soon as the arrow has cleared the arrow rest, the deflected finger 62 is returned by spring 70 to its normal position. It should be noted that the independent mounting of the fingers 62 and 64 and the separate action provided by the two springs 70 and 78 permits the fingers 62 and 64 to be deflected equally or unequally, depending upon the nature of the force applied to them in use.

Because each finger 62 and 64 has its own spring, the springs 70 and 78 can be relatively small springs, and only the force of either spring must be overcome in order to permit the corresponding finger to deflect from its normal position.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An arrow rest for an archery bow, said arrow rest comprising:

a mounting base;

means for attaching said mounting base to the bow at a preselected location;

a pair of finger elements each having an arrow receiving tip portion;

means for mounting said finger elements on said base for movement independently of one another between first and second positions, said finger elements being situated in the first positions thereof with said tip portions located to receive and support an arrow applied in the bow in position for shooting;

said mounting means comprising a block for each finger element, means for mounting said blocks on said base for pivotal movement, independently of one another about a pivot axis, and means for securing said fingers to the respective blocks in extension therefrom; and yieldable means for biasing each finger element toward the first position thereof, said yieldable means being arranged to permit each finger element to deflect away from the first position thereof independently of the other finger element.

2. The arrow rest of claim 1, wherein said tip portions of the finger elements are curved in a direction away from one another when the finger elements are in the first positions thereof.

3. The arrow rest of claim 1, including stop means for preventing each finger element from moving in one direction beyond said first position.

4. The arrow rest of claim 1, wherein said yieldable means comprises a pair of springs acting independently of one another and extending between said base and the respective blocks in a manner to continuously urge the blocks about said pivot axis in a direction to bias the blocks toward said first positions of the finger elements.

5. The arrow rest of claim 4, including stop means on said base for preventing each block from pivoting in said direction beyond a location at which the corresponding finger element occupies the first position thereof.

6. The arrow rest of claim 4, wherein said attaching means comprises a rigid bracket adapted to be rigidly secured to the bow and a pin extending from said bracket and having an axis coincident with said pivot axis, said base being mounted in a manner to preclude pivotal movement of the base about said axis.

7. The arrow rest of claim 1, wherein said attaching means comprises a rigid bracket adapted to be secured to the bow, said bracket carrying said mounting base thereon.

8. An arrow rest for an archery bow, aid arrow rest comprising:

a mounting base;

mounting bracket means for attaching said mounting base to the bow with the base spaced from the bow;

first and second fingers each having an arrow receiving upper tip portion;

means for mounting said first finger on said base for movement about a pivot axis between a normal position and a deflected position, said means for mounting said first finger comprising a first block carrying aid first finger and mounted on said base for pivotal movement between the normal and deflected positions of the first finger;

means for mounting said second finger on said base for movement about said pivot axis independently of said first finger between a normal position and a deflected position of the second finger, said means for mounting said second finger comprising a second block carrying said second finger and mounted on said base for pivotal movement independently of the first block between the normal and deflected positions of the second finger, said first and second fingers extending away from said base on an incline in the normal positions thereof with said tip portions located to receive and support thereon an arrow applied in the bow in position for shooting;

first spring means for urging said first finger toward the normal position thereof, said first spring means yielding to permit movement of the first finger to the deflected position in response to forces exerted by the arrow on the first finger; and second spring means acting independently of said first spring means for urging said second finger toward the normal position thereof, said second spring means yielding to permit said second finger to move to the deflected position thereof independently of the first finger in response to forces exerted by the arrow on the second finger.

9. The arrow rest of claim 8, wherein:

said first spring means comprises a first spring element connected to said base and said first block and acting to urge said first block about said pivot axis in a direction to maintain the first finger in the normal position thereof; and said second spring means comprises a second spring element connected to said base and said second block and acting independently of said first spring element to urge said second block about said pivot axis in a direction to maintain the second finger in the normal position thereof.

10. The arrow rest of claim 9, including stop means on said base for limiting pivotal movement of each block in said direction to a position of the block at which the finger carried thereon assumes said normal position thereof.

11. The arrow rest of claim 8, wherein said tip portions of the first and second fingers curve away from one another when both fingers are in the normal position.

* * * * *